US010752457B1

(12) United States Patent
Hoffman et al.

(10) Patent No.: US 10,752,457 B1
(45) Date of Patent: Aug. 25, 2020

(54) INK JET CARD PRINTER HAVING A PIVOTABLE CARD FEEDER

(71) Applicant: Assa Abloy AB, Stockholm (SE)

(72) Inventors: Ted M. Hoffman, Eden Prairie, MN (US); Tanya Snyder, Edina, MN (US); John Skoglund, Prior Lake, MN (US)

(73) Assignee: ASSA ABLOY AB, Stockholm (SE)

( * ) Notice: Subject to any disclaimer, the term of this patent is extended or adjusted under 35 U.S.C. 154(b) by 0 days.

(21) Appl. No.: 16/265,253

(22) Filed: Feb. 1, 2019

(51) Int. Cl.
*B65H 5/04* (2006.01)
*B41J 13/08* (2006.01)
(Continued)

(52) U.S. Cl.
CPC ..... *B65H 5/04* (2013.01); *B41J 13/08* (2013.01); *B41J 3/60* (2013.01); *B41J 3/62* (2013.01); *B41J 11/007* (2013.01); *B41J 11/008* (2013.01); *B41J 11/0065* (2013.01); *B41J 11/0085* (2013.01); *B41J 11/0095* (2013.01); *B41J 13/0009* (2013.01); *B41J 13/26* (2013.01); *B41J 29/02* (2013.01); *B65H 5/02* (2013.01); *B65H 5/021* (2013.01); *B65H 5/06* (2013.01); *B65H 5/062* (2013.01); *B65H 9/00* (2013.01); *B65H 9/004* (2013.01); *B65H 9/04* (2013.01); *B65H 9/10* (2013.01); *B65H 9/101* (2013.01); *B65H 2701/1914* (2013.01)

(58) Field of Classification Search
CPC .. B65H 5/04; B65H 2701/1914; B65H 5/062; B65H 5/02; B65H 5/06; B65H 5/021; B65H 9/00; B65H 9/101; B65H 9/04; B65H 9/004; B65H 9/10; B41J 13/26; B41J 29/02; B41J 13/08; B41J 11/0065; B41J 11/0085; B41J 11/007; B41J 3/62; B41J 11/0095; B41J 13/0009; B41J 3/60; B41J 11/008
See application file for complete search history.

(56) References Cited

U.S. PATENT DOCUMENTS 6,672,720 B2 1/2004 Smith
6,702,282 B2 3/2004 Pribula et al.
(Continued)

FOREIGN PATENT DOCUMENTS

WO WO-2019010027 A1 1/2019

OTHER PUBLICATIONS

"European Application Serial No. 20154289.1, Extended European Search Report dated may 15, 2020", 10 pgs.

*Primary Examiner* — Justin Seo
(74) *Attorney, Agent, or Firm* — Schwegman Lundberg & Woessner, P.A.

(57) ABSTRACT

An ink jet card printer includes an ink jet print head, a gantry, and a card feeder. The ink jet print head is configured to perform a print operation on a card supported in a print position along a processing axis. The gantry is configured to move the print head through a print zone. The card feeder includes a feeder frame, a first pinch roller pair, and a lift mechanism. The first pinch roller pair is supported by the feeder frame and is configured to feed individual cards along a card feed axis. The lift mechanism is configured to move the feeder frame and the first pinch roller pair between a lowered position, in which the card feeder is displaced from the print zone, and a raised position, in which at least a portion of the card feeder extends into the print zone.

20 Claims, 11 Drawing Sheets

(51) Int. Cl.

| | |
|---|---|
| *B41J 29/02* | (2006.01) |
| *B65H 5/06* | (2006.01) |
| *B41J 13/26* | (2006.01) |
| *B65H 9/04* | (2006.01) |
| *B65H 9/10* | (2006.01) |
| *B65H 9/00* | (2006.01) |
| *B65H 5/02* | (2006.01) |
| *B41J 11/00* | (2006.01) |
| *B41J 3/60* | (2006.01) |
| *B41J 13/00* | (2006.01) |
| *B41J 3/62* | (2006.01) |

(56) References Cited

U.S. PATENT DOCUMENTS

| | | | | |
|---|---|---|---|---|
| 7,063,013 | B2 | 6/2006 | Jones et al. | |
| 2014/0232799 | A1* | 8/2014 | Sano ..... | B41J 11/007<br>347/104 |

* cited by examiner

INK JET CARD PRINTER HAVING A PIVOTABLE CARD FEEDER

BACKGROUND

Card products include, for example, credit cards, identification cards, driver's licenses, passports, and other card products. Such card products generally include printed information, such as a photo, account numbers, identification numbers, and other personal information. Credentials can also include data that is encoded in a smartcard chip, a magnetic stripe, or a barcode, for example.

Card production systems include processing devices that process card substrates (hereinafter "cards") to form the final card product. Such processes may include a printing process, a laminating or transfer process, a data reading process, a data writing process, and/or other process used to form the desired credential. An ink jet card printer is a form of card production system that utilizes an ink jet print head to print images to cards.

SUMMARY

Embodiments of the present disclosure are directed to an ink jet card printer, a method of feeding a card in an ink jet card printer, and a card feeder. One embodiment of the ink jet card printer includes an ink jet print head, a gantry, and a card feeder. The ink jet print head is configured to perform a print operation on a card supported in a print position along a processing axis. The gantry is configured to move the print head through a print zone. The card feeder includes a feeder frame, a first pinch roller pair, and a lift mechanism. The first pinch roller pair is supported by the feeder frame and is configured to feed individual cards along a card feed axis. The lift mechanism is configured to move the feeder frame and the first pinch roller pair between a lowered position, in which the card feeder is displaced from the print zone, and a raised position, in which at least a portion of the card feeder extends into the print zone.

In one embodiment of a method of feeding a card in an ink jet printer, which includes an ink jet print head supported for movement within a print zone during printing of an image to a card supported along a processing axis, a card is supported in a card feeder in a raised position, in which at least a portion of the card feeder extends into the print zone. The card is fed from the card feeder along a card feed axis that is substantially parallel to the processing axis to a card transport using a first pinch roller pair supported by a feeder frame of the card feeder. The feeder frame, the first pinch roller pair, and the card feed axis is pivoted about a pivoted axis to a lowered position, in which the card feeder is displaced from the print zone and the card feed axis is oblique to the processing axis, using a lift mechanism.

One embodiment of the card feeder includes a feeder frame, a first pinch roller pair, and a lift mechanism. The first pinch roller pair is supported by the feeder frame and is configured to feed individual cards along a card feed axis. The lift mechanism is configured to pivot the feeder frame and the first pinch roller pair about a pivot axis between a lowered position, in which the card feed axis has a first angular position about the pivot axis, and a raised position, in which the card feed axis has a second angular position about the pivot axis that is different from the first angular position.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the Background.

DETAILED DESCRIPTION OF ILLUSTRATIVE EMBODIMENTS

Figure 1:
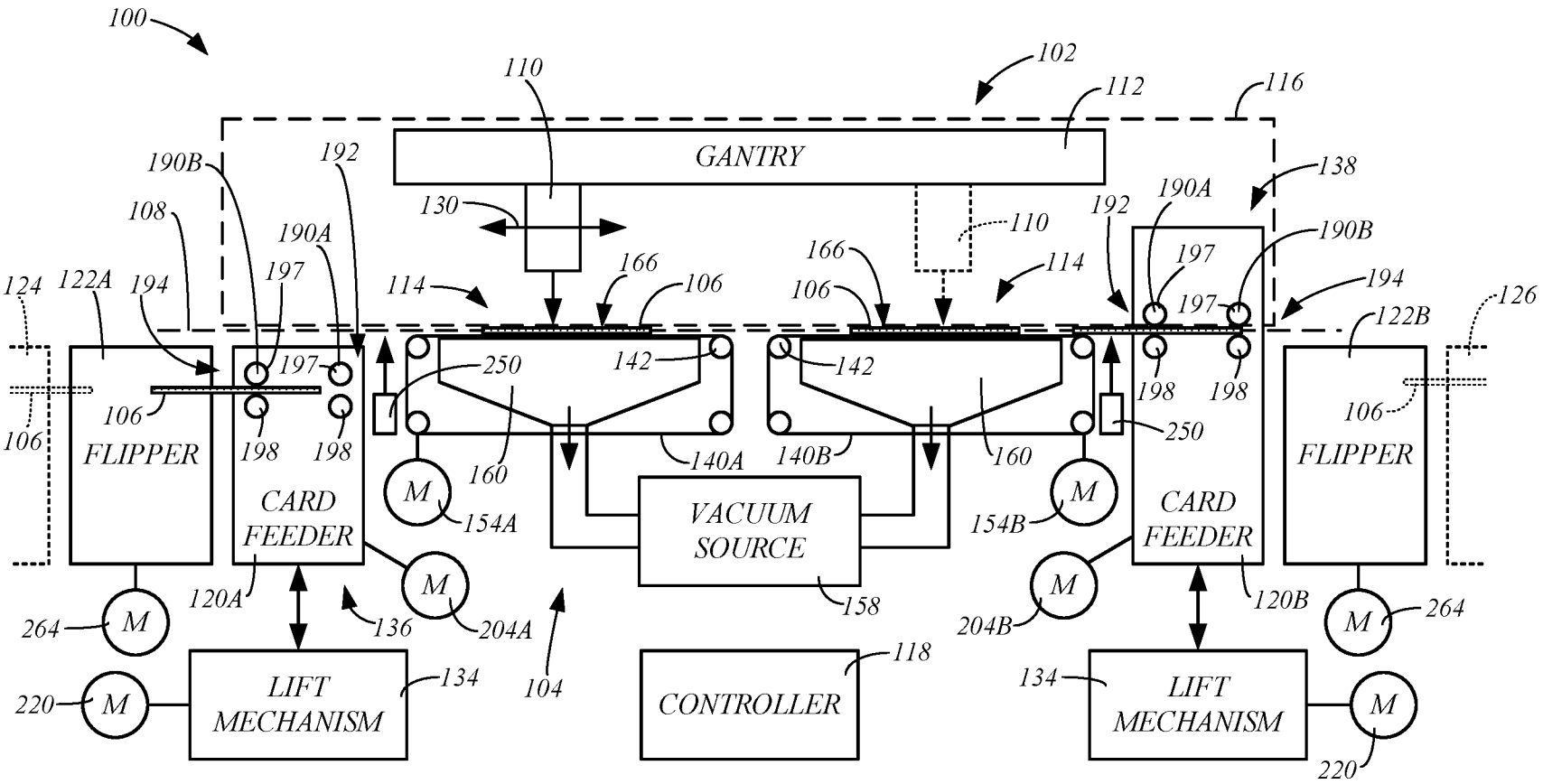
FIGS. 1 and 2 are simplified side and top views of an ink jet card printer, in accordance with embodiments of the present disclosure.

Embodiments of the present disclosure are generally directed to a card feeder of an ink jet card printer that is configured to facilitate the feeding individual cards to a print position for printing by an ink jet print head that is moved through a print zone using a gantry during printing operations. The card feeder has a raised position, in which at least a portion of the card feeder extends into the print zone. As a result, the card feeder would obstruct printing operations if left in the raised position. This issue is avoided by moving the card feeder to a lowered position during printing operations, in which the card feeder is displaced from the print zone, using a lift mechanism.

These and other embodiments of the present disclosure are described more fully hereinafter with reference to the accompanying drawings. Elements that are identified using the same or similar reference characters refer to the same or similar elements. The various embodiments of the present disclosure may, however, be embodied in many different forms and should not be construed as limited to the embodiments set forth herein. Rather, these embodiments are provided so that this disclosure will be thorough and complete, and will fully convey the scope of the present disclosure to those skilled in the art.

Figure 2:
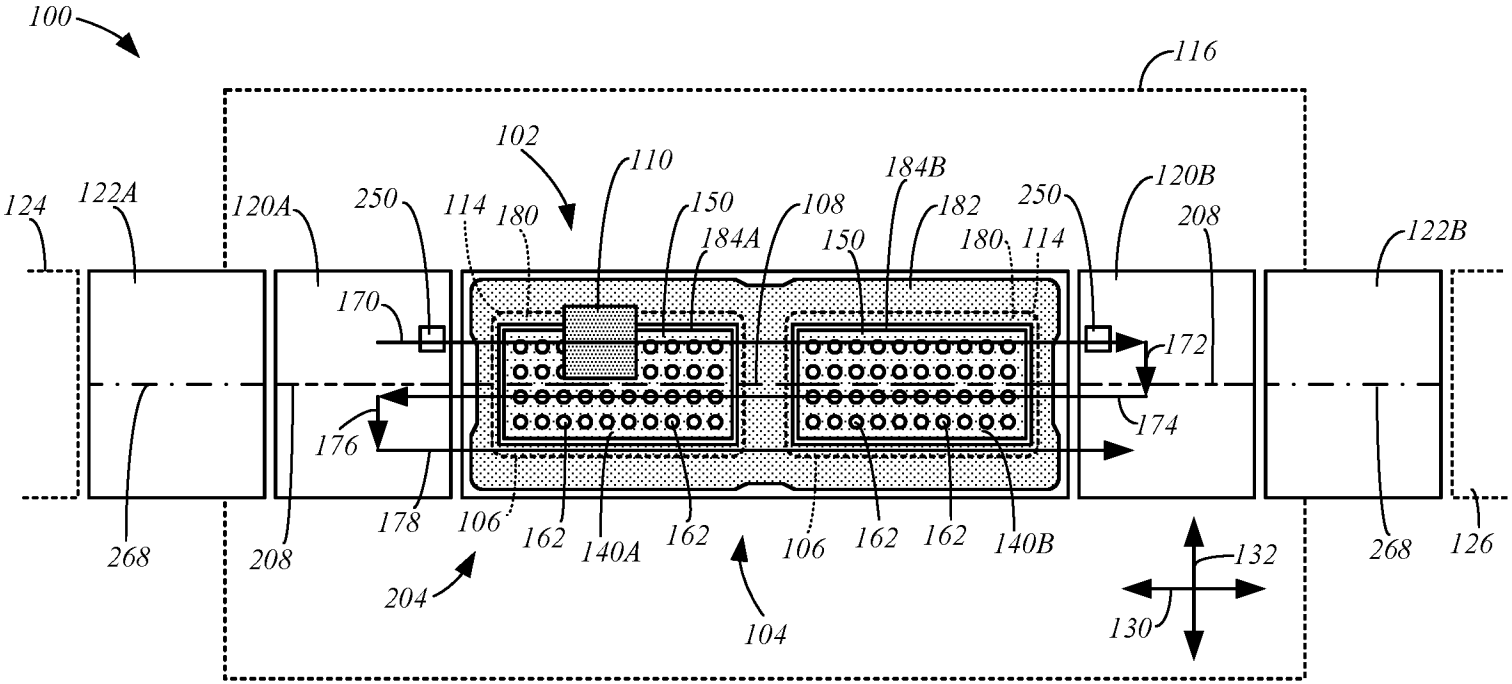

FIGS. 1 and 2 are simplified side and top views of an ink jet card printer 100 in accordance with embodiments of the present disclosure. In some embodiments, the printer 100 includes a print unit 102, and a card transport 104. The card transport 104 is configured to feed individual cards 106 along a processing axis 108. The print unit 102 includes an ink jet print head 110 and a gantry 112. The print head 110 is configured to perform a printing operation on individual cards 106 supported by the card transport 104 in a print position 114 along the processing axis 108. The gantry 112 is configured to move the print head 110 through a print zone 116 during printing operations.

In some embodiments, the printer 100 includes a controller 118, which represents one or more distinct controllers of the printer 100, each of which includes at least one processor that is configured to execute program instructions stored in a computer-readable media or memory of the printer 100, which may also be represented by the controller 118, or another location. Any suitable patent subject matter eligible computer readable media or memory may be utilized including, for example, hard disks, CD-ROMS, optical storage devices, flash memory, magnetic storage devices, or other suitable computer readable media or memory that do not include transitory waves or signals. The execution of the instructions by the controller 118 controls components of the printer 100 to perform functions and method steps described herein.

As discussed in greater detail below, the card printer 100 may include one or more card feeders 120, such as card feeders 120A and 120B, that are each configured to deliver cards 106 to, and receive cards 106 from, the card transport 104. The printer 100 may also include one or more conventional card flippers 122, such as flippers 122A and 122B, that are configured to invert the cards 106. A conventional card supply 124, such as a card cartridge containing a stack of cards, may be provided to supply cards 106 for processing by the printer 100, and processed cards may be discharged and collected by a suitable card collector (e.g., a hopper) 126.

The ink jet print head 110 may be any suitable conventional ink jet print head that is configured to perform a direct printing operation to individual cards 106 supported in the print positions 114 along the processing axis 108. The gantry 112 includes a conventional gantry for moving the print head 110 along a fast scan axis 130 that is substantially parallel to the processing axis 108, and a slow scan axis 132 that is substantially perpendicular to the processing axis 108, as shown in FIG. 2, during printing operations. As used herein, the term "fast scan axis" refers to the axis along which the print head 110 is moved by the gantry 112 during an active printing phase of the operation, during which ink is discharged from the print head 110 to form the image on the card 106. The term "slow scan axis" refers to the axis along which the print head 110 is moved by the gantry 112 during an inactive printing phase (ink is not discharged from the print head) to position the print head 110 for the next active printing phase.

In some embodiments, the gantry 112 and the print head 110 may occupy the print zone 116 during printing operations, which is indicated by dashed boxes in FIGS. 1 and 2. The print zone 116 generally extends from the processing axis 108, or immediately above the processing axis 108, into the space above the card transport 104 and the card feeders 120. The print zone 116 may also surround the card transport 104 and the card feeders 120, as shown in FIG. 2.

Figure 3:
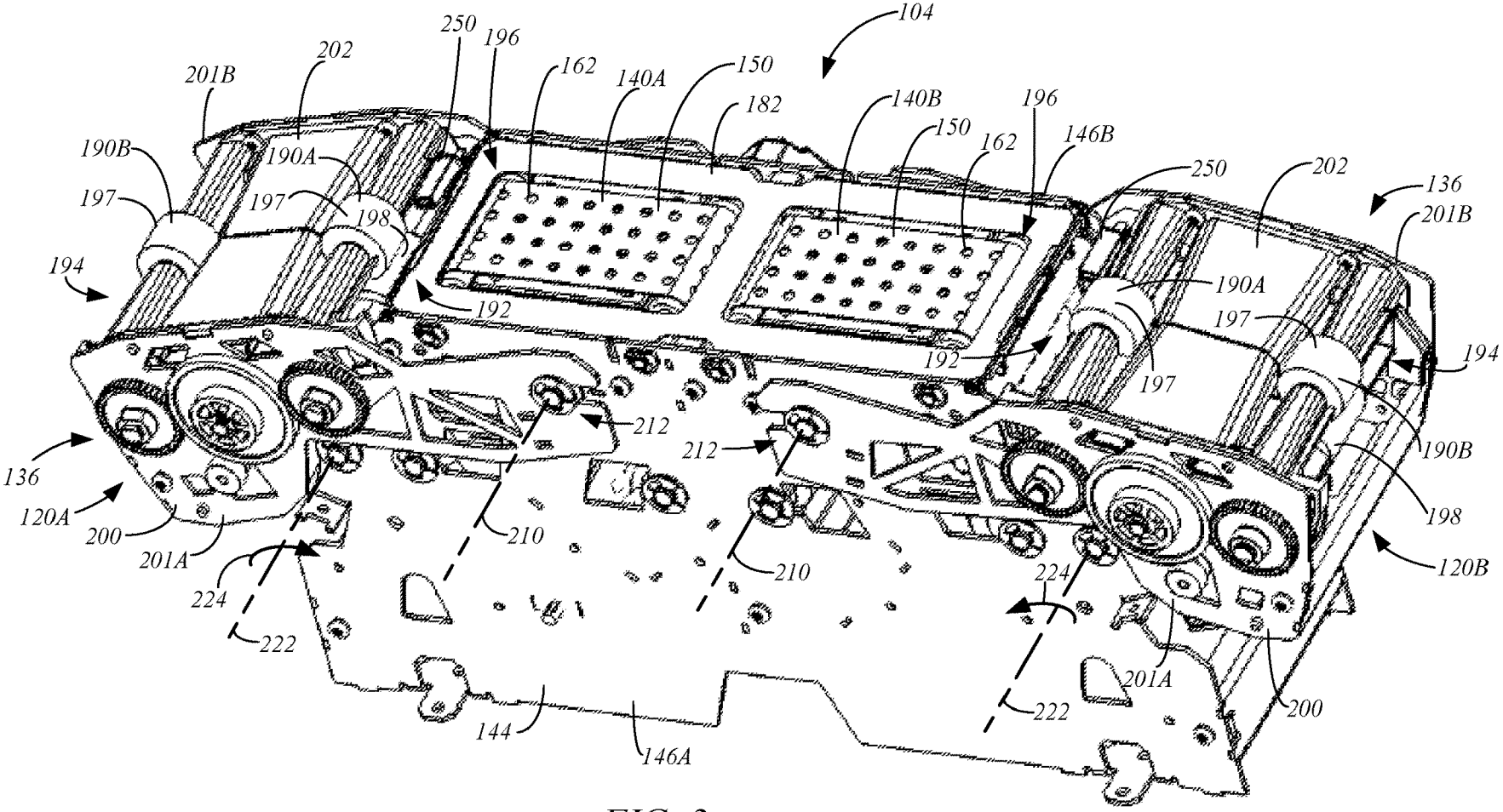
FIG. 3 is an isometric view of an exemplary card transport and card feeders (lowered positions), in accordance with embodiments of the present disclosure.
Figure 4:
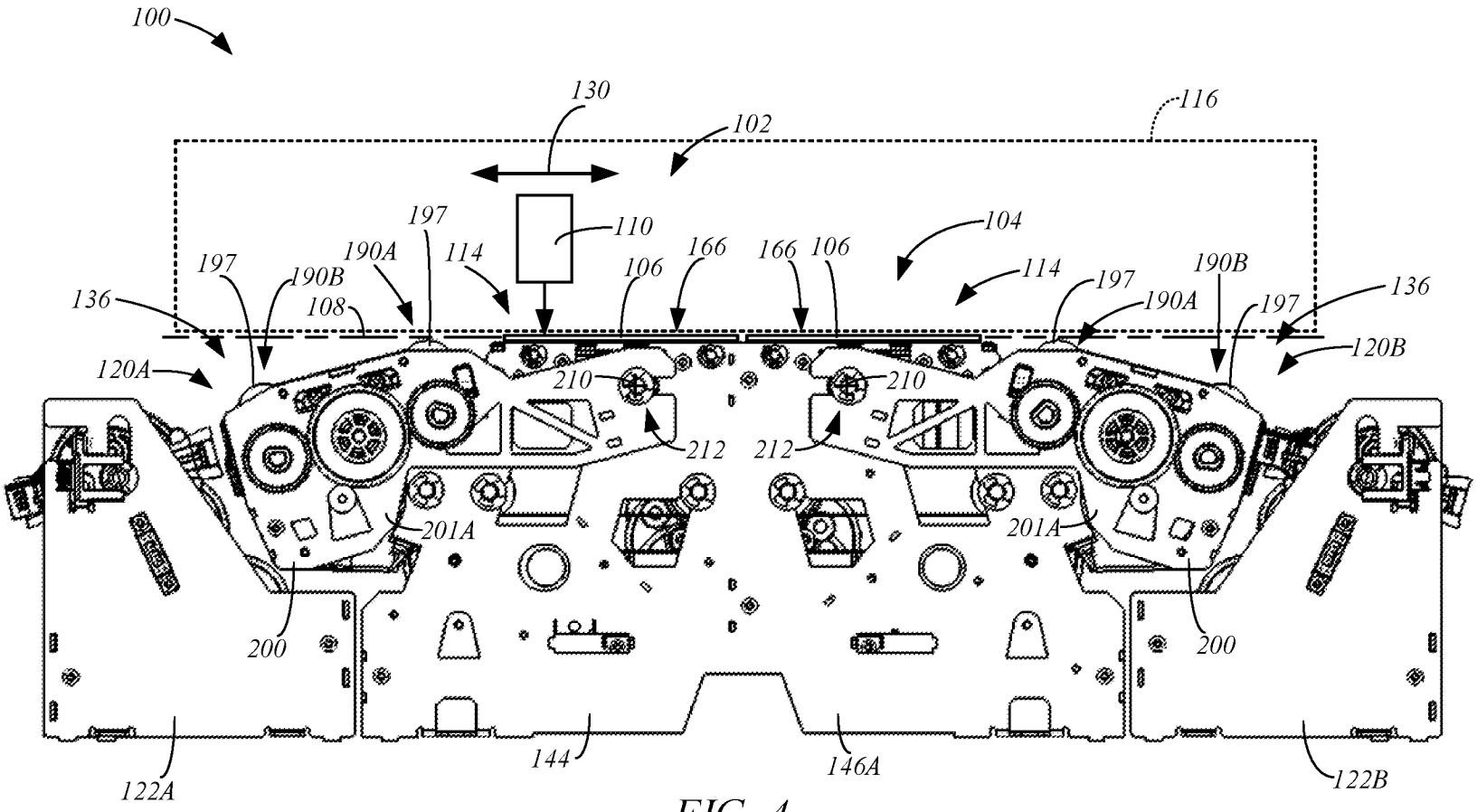
FIG. 4 is a side view of an exemplary ink jet card printer with the card feeders in their lowered positions, in accordance with embodiments of the present disclosure.
Figure 5:
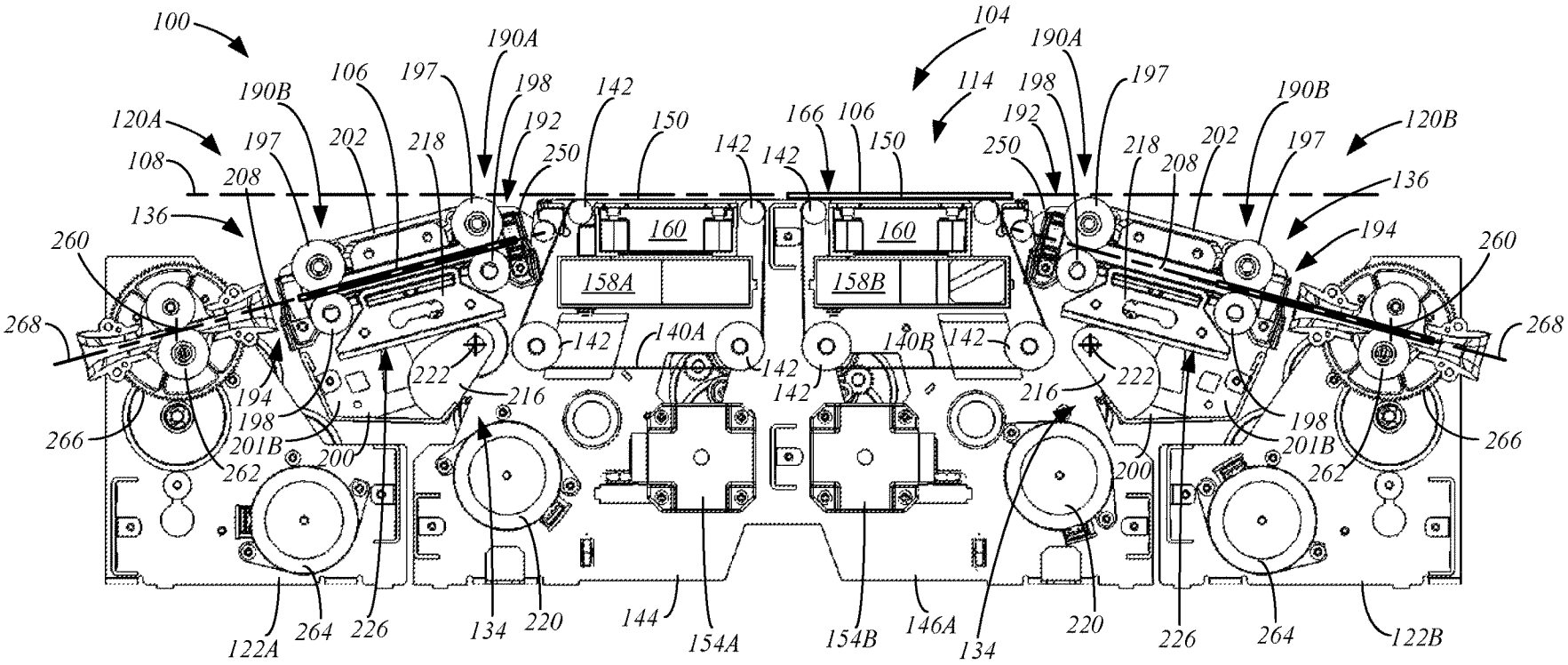
FIG. 5 is a side view of the printer of FIG. 4 with frame sidewalls removed, in accordance with embodiments of the present disclosure.

In some embodiments, the card feeders 120 each include a lift mechanism 134 to move the card feeders 120 to a lowered position 136, in which the card feeders 120 are displaced from the print zone 116, such as below the print zone 116, as indicated by card feeder 120A in FIG. 1, and the card feeders 120A and 120B in FIGS. 3-5. FIG. 3 is an isometric view of exemplary card transport 104 and card feeders 120 in their lowered positions 136, FIG. 4 is a side view of an exemplary printer 100 with the card feeders 120 in their lowered positions 136, and FIG. 5 is a side view of the printer 100 of FIG. 4 with frame side walls removed, in accordance with embodiments of the present disclosure.

Figure 6:
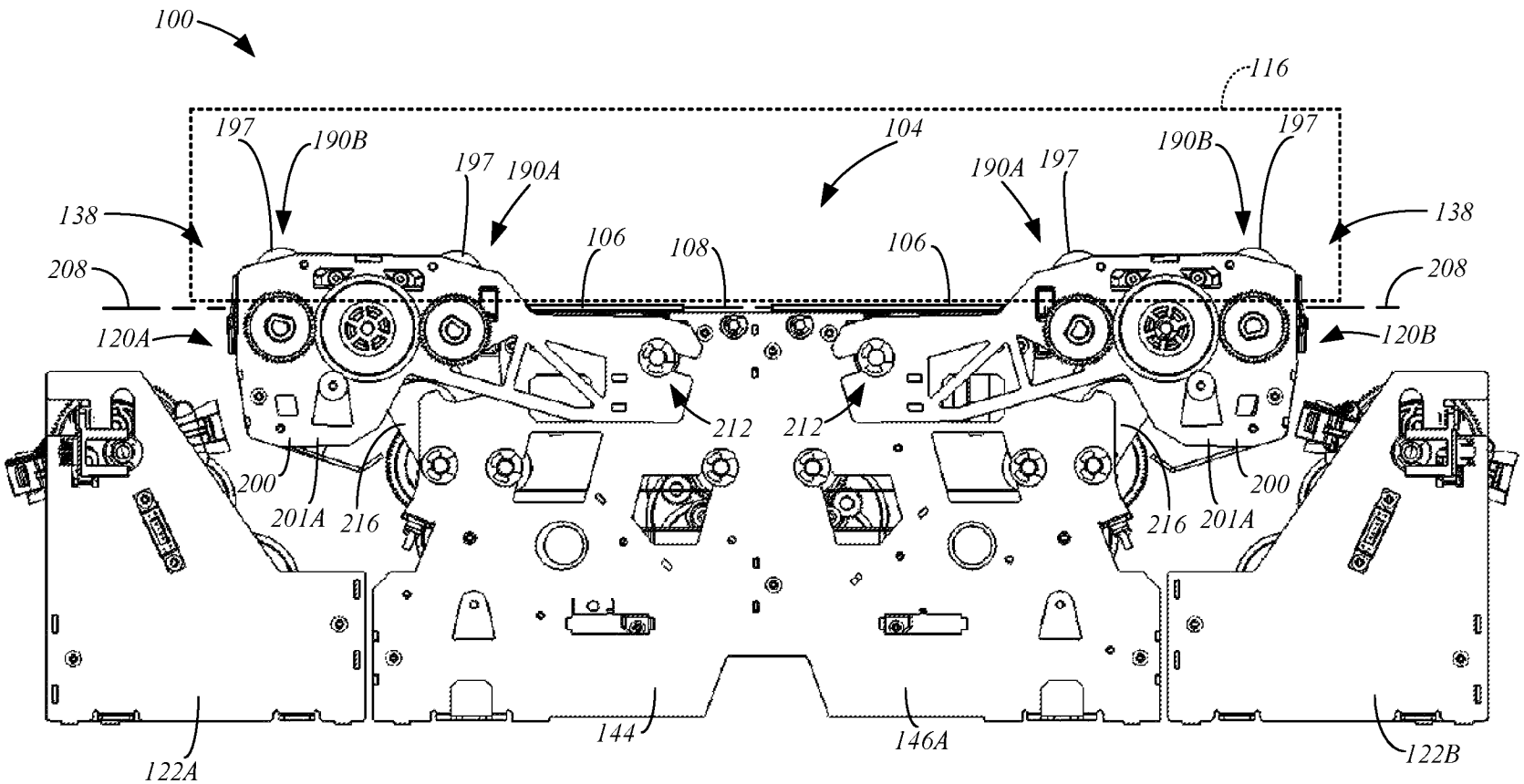
FIG. 6 is a side view of the printer of FIG. 4 with the card feeders in their raised positions, in accordance with embodiments of the present disclosure.
Figure 7:
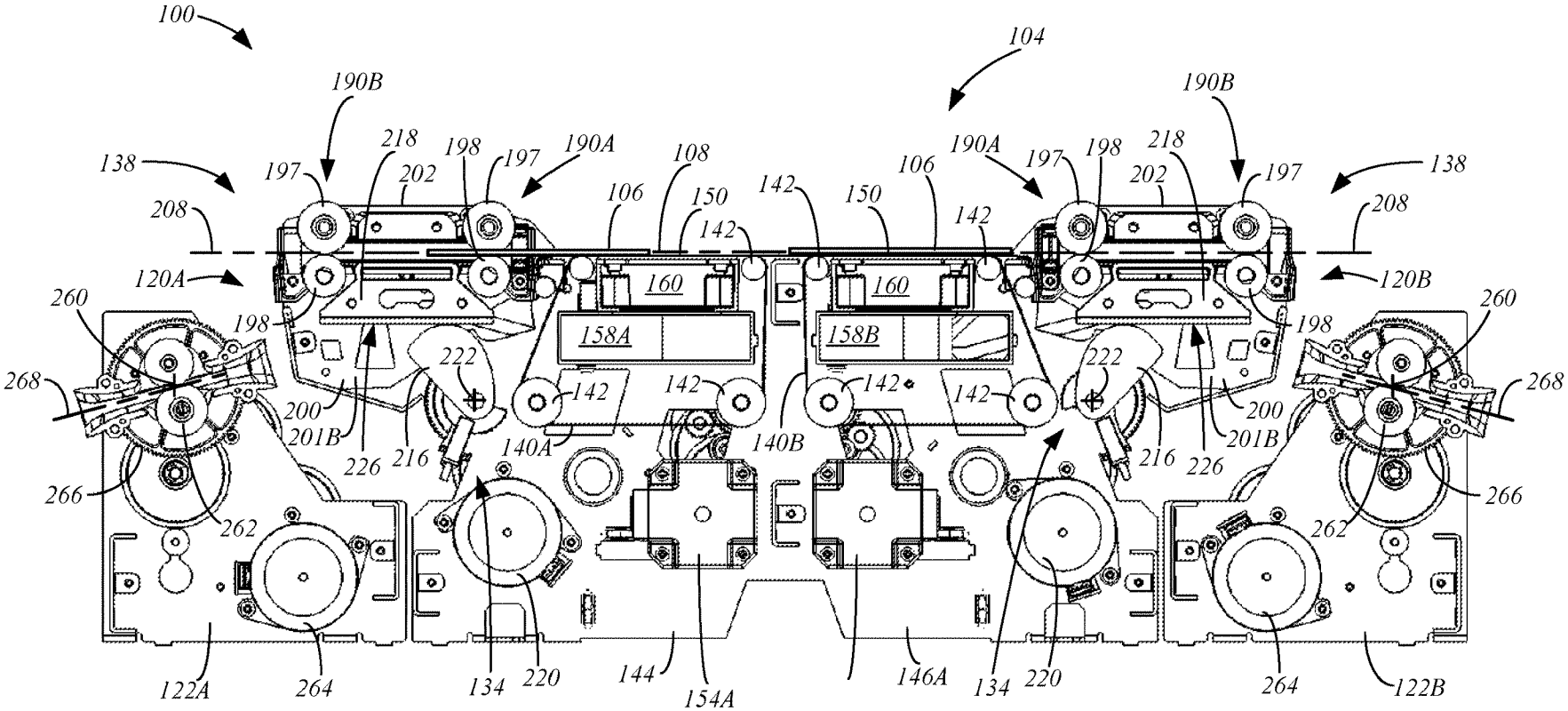
FIG. 7 is a side view of the printer of FIG. 6 with frame sidewalls removed, in accordance with embodiments of the present disclosure.

The lift mechanisms 134 may also move the card feeders 120 to a raised position 138, in which at least a portion of the card feeders 120 extend into the print zone 116, and the card feeders 120 are positioned to feed cards 106 to, or receive cards 106 from, the card transport 104, as indicated by the card feeder 120B in FIG. 1 and the card feeders 120A and 120B in FIGS. 6 and 7. FIG. 6 is a side view of the exemplary printer 100 of FIG. 4 with the card feeders 120 in their raised positions, and FIG. 7 is a side view of the printer 100 of FIG. 6 with frame side walls removed, in accordance with embodiments of the present disclosure. Thus, the card feeders 120 may be moved to their raised positions 138 by the lift mechanisms 134 to facilitate feeding cards 106 to, or receiving cards 106 from the card transport 104.

Thus, the lift mechanisms 134 may be used to move the card feeders 120 from their raised positions 138, in which at least a portion of the card feeders 120 would obstruct a printing operation, to their lowered positions 136, in which the card feeders 120 do not obstruct the print zone 116, to enable the print head 110 to be moved through the print zone 116 by the gantry 112 and perform a printing operation.

In some embodiments, the card transport 104 includes belts 140, such as first and second belts 140A and 140B (i.e., belt feeders or conveyors), that are each supported by rollers 142 for movement along a belt path. In one example, the first and second belts 140A and 140B are each supported by four rollers 142, which are supported by a belt frame 144, such as side walls 146A and 146B of the belt frame 144 (FIG. 3). The belts 140 include exposed portions 150 adjacent the processing axis 108. The exposed portion 150 of each of the belts 140 is used to feed the cards 106 along the processing axis 108 and support the cards 106 in the print positions 114.

Motors 154A and 154B are respectively configured to independently drive the first and second belts 140A and 140B along their belt paths. Thus, the exposed portion 150 of the first belt 140A may independently feed a card 106 along the processing axis 108 in a direction toward the second belt 140B or in a direction toward the card feeder 120A using the motor 154A, and the exposed portion 150 of the second belt 140B may independently feed a card 106 along the processing axis 108 in the direction toward the first belt 140A, or in the direction toward the card feeder 120B using the motor 154B.

The belts 140 of the card transport 104 may take on any suitable form. In some embodiments, the belts 140 are conventional vacuum belts that are coupled to a vacuum source 158 (i.e., a source of negative pressure), such as a regenerative vacuum blower. The vacuum source 158 may be shared by the belts 140, as shown in FIG. 1, or separate vacuum sources 158A and 158B may respectively be used by the belts 140A and 140B, as shown in FIG. 5. Chambers 160 couple the negative pressure generated by the vacuum source 158 to the exposed portions 150 of the belts 140. The negative pressure is communicated to a top side of the exposed portions 150 through apertures 162 in the belts, which are shown in FIGS. 2 and 3, and is used to secure cards 106 to the exposed portions 150 during card feeding and printing operations. Thus, when a card 106 engages the top surface of the exposed portion 150 of one of the belts 140, the negative pressure generated by the vacuum source 158 or sources 158A and 158B adheres the card 106 to the belt 140. When the belts 140 are driven by the corresponding motor 154, the adhered card 106 is driven along the processing axis 108.

During a printing operation, with the card feeders 120 in their lowered positions 136, each of the belts 140 may feed a card 106 along the processing axis 108 to the corresponding print position 114, in which the exposed top surfaces 166 of the cards 106 are at the border of the print zone 116, as shown in FIGS. 1, 2, 4 and 5. The print head 110 may perform a print operation on the top surfaces 166 of the cards 106 supported in the print positions 114. Thus, the print head 110 may print an image to the exposed surface 166 of the card 106 supported in the print position 114 on the belt 140A, print an image to the surface 166 of the card 106 supported in the print position 114 on the belt 140B, and/or simultaneously print images to the surfaces 166 of both cards 106 supported in the print positions 114 on the belts 140A and 140B during a single printing operation.

For example, referring to FIG. 2, with the card feeders 120 in their lowered positions 136, and the cards 106 held in the print positions 114 against the exposed portions 150 of the belts 140A and 140B due to the negative pressure generated by the vacuum source 158 or sources 158A and 158B (FIGS. 1, 2, 4 and 5), the gantry 112 may move the print head 110 along the fast scan axis 130 (processing axis 108) over the cards 106, while the print head 110 prints image lines to the surfaces 166, as indicted by arrow 170. After the print head 110 is moved past the end of the card 106 adjacent the card feeder 120B, the gantry 112 shifts the print head 110 along the slow scan axis 132, as indicated by arrow 172. The gantry 112 then moves the print head 110 back along the fast scan axis 130 (arrow 174), during which the print head 110 prints image lines to the surfaces 166 of the cards 106. The gantry 112 again shifts the position of the print head 110 along the slow scan axis 132 (arrow 176), and the print head 110 prints image lines as the gantry 112 moves the print head 110 along the fast scan axis 130 (arrow 178). These steps of printing image lines while moving the print head 110 along the fast scan axis 130 and shifting the position of the print head 110 along the slow scan axis 132, are repeated until the images have been printed to the surfaces 166 of the cards 106. Accordingly, a single print operation may simultaneously print images to two cards 106 supported on the belts 140.

To print a full edge-to-edge image on a card 106, the print head 110 may be configured to print an image that is slightly larger than the surface 166 of the card 106. As a result, some ink will overspray the edges of the card 106.

In some embodiments, the exposed surface 150 of each belt 140 has a smaller surface area than the card 106. That is, the width and length of the exposed belt surfaces 150 are selected such that they are less than the corresponding width and length of the cards 106, as generally shown in FIG. 2 with the cards 106 shown in phantom lines. Thus, when a card 106 is in the print position 114, the entirety of the exposed belt surface 150 is covered by the card 106, and a perimeter portion 180 of the card 160 extends beyond the edges of the exposed belt surface 150. This allows the print head 110 to print images that extend to the edges of the surfaces 166 of cards 106 while protecting the exposed belt surface 150 from ink contamination.

In some embodiments, the printer 100 includes an ink overspray collector 182 that surrounds a perimeter of the exposed belt surface 150 and extends beyond the edges of the cards 106 when in their print positions 114, as shown in FIG. 2. Thus, the collector 182 is positioned to receive ink that is sprayed over the lengthwise and widthwise edges of the cards 106 during a printing operation. In some embodiments, the ink overspray collector 182 is a disposable component that may be periodically removed and replaced by an operator of the printer 100. The collector 182 may be formed of plastic, paper, cardboard, or another suitable material. In some embodiments, the collector 182 is a single piece of material having an opening 184A for the exposed belt surface 150 of the belt 140A, and an opening 184B for the exposed belt surface 150 of the belt 140B.

As mentioned above, the card feeders 120 are each configured to deliver cards 106 to, and receive cards 106 from the card transport 104 when in their raised positions 138 (FIGS. 6 and 7). The card feeders 120 may also receive cards 106 for processing from the card supply 124, such as using card feeder 120A, and discharge processed cards 106 to the collector 126, such as using the card feeder 120B, as indicated in FIG. 1.

In some embodiments, the card feeders 120 each include at least one pinch roller pair 190, such as pinch roller pairs 190A and 190B, as shown in FIGS. 1, 5 and 7. In some embodiments, at least a portion of one or both of the pinch roller pairs 200 extends into the print zone 116 when the card feeder 120 is in the raised position 138, as shown in FIG. 7. The pinch roller pairs 190A and 190B are respectively positioned adjacent ports 192 and 194 of the card feeder 120, with the port 192 being positioned adjacent an input/output end 196 of the corresponding belt 140, as shown in FIG. 3. Each pinch roller pair 190 may include an idler roller 197 and a motorized feed roller 198 (FIGS. 5 and 7) that are supported by a card feeder frame 200, such as between side walls 201A and 201B of the frame 200, as shown in FIG. 3. While the idler roller 197 is illustrated as being the top roller in the provided examples, it is understood that the positions of the rollers 197 and 198 may be reversed. A cover 202 may be positioned between the pinch roller pairs 190A and 190B to cover a portion of the path through which cards 106 are fed through the card feeder 120, as shown in FIG. 3.

The card feeders 120A and 120B respectively include motors 204A and 204B (FIG. 1) for driving the motorized rollers 198 to feed a card 106 supported between one or both of the pinch roller pairs 190A and 190B along a card feed axis 208. The separate motors 204 of the feeders 120 allow the controller 118 to independently control the card feeders 120. As a result, the card feeder 120A may be used to deliver a card 106 to the belt 140A while the card feeder 120B delivers a card 106 to the collector 126, for example.

The card feed axis 208 of each feeder 120 is substantially parallel to a vertical plane extending through the processing axis 108. Thus, as shown in the top view of FIG. 2, the card feed axes 208 of the feeders 120 are oriented substantially parallel (e.g., ±5 degrees) to the processing axis 108 within a horizontal plane.

In some embodiments, the lift mechanisms 134 pivot the frame 200 of the card feeders 120 about a pivot axis 210 (FIG. 3) during movement of the card feeders 120 between their raised and lowered positions 138 and 136. As a result, the orientation of the card feed axis 208 relative to the processing axis 108 in a vertical plane changes with movement of the card feeders 120 between their raised and lowered positions 138 and 136. When the card feeder 120 is in its lowered position 136, the card feed axis 208 is at an oblique angle (e.g., 20-50 degrees) to the processing axis 108 in the vertical plane, as shown in FIG. 5. When the card feeder 120 is in its raised position, the card feed axis 208 is substantially parallel to the processing axis 108 in the vertical plane, as shown in FIG. 7, allowing the card feeder 120 to deliver a card 106 to the adjacent belt 140, or receive a card 106 from the adjacent belt 140 using one or more of the pinch roller pairs 190.

In some embodiments, the pivot axis 210 is defined by a pivotable connection 212 between the card feeder frame 200 and the belt frame 144, as indicated in FIG. 3. In one embodiment, the pivotable connection or hinge 212 is formed between the side walls 201A and 201B of the card feeder frame 200 and the corresponding side walls 146A and 146B of the belt frame 144.

In one exemplary embodiment, each lift mechanism 134 includes a cam 216, a cam follower 218 and a motor 220, as shown in FIGS. 5 and 7. The separate motors 220 allow the controller 118 to independently control each lift mechanism 134. In one example, each cam 216 is supported by the belt frame 144 for rotation about an axis 222 (FIG. 3), and each cam follower 218 is supported by the card feeder frame 200 and pivots with the card feeder frame 200 about the pivot axis 210. Alternatively, the positions of the cam 216 and the cam follower 218 may be reversed where the cam 216 is supported by the belt frame 144 and the cam follower 218 is supported by the card feeder frame 200. In some embodiments, the cam follower 218 is biased to engage the cam 216 using a suitable biasing mechanism, such as a spring.

During an exemplary lift operation, in which the card feeder 120 is moved from the lowered position 136 (FIG. 5) to the raised position 138 (FIG. 7), the controller 118 activates the motor 220 of the lift mechanism 134 to drive rotation of the cam 216 about the axis 222 in the direction indicated by arrow 224 in FIG. 3. As the cam 216 rotates, it slides and presses against a cam surface 226 (FIG. 5) of the cam follower 218. This drives the card feeder frame 120 to pivot about the pivot axis 210 until the card feeder 120 reaches the raised position 138 shown in FIG. 7. The operation is reversed to move the card feeder 120 back to its lowered position 136. That is, the controller activates the motor 220 of the lift mechanism 134 to drive rotation of the cam 216 about the axis 222 in the direction opposite arrow 224 (FIG. 3). During this rotation of the cam 216, the cam surface 226 of the cam follower 218 slides along the cam 216 and the card feeder frame 200 pivots about the pivot axis 210 until the card feeder 120 reaches the lowered position 136 shown in FIG. 5.

Alternative lift mechanisms 134 may also be employed. For example, different lift mechanisms may be used to pivot the card feeders 120 between their raised and lowered positions 138 and 136, such as a screw drive, or another suitable lift mechanism. Additionally, the lift mechanisms 134 may be configured to move the card feeders 120 linearly between the raised and lowered positions 138 and 136.

Figure 8:
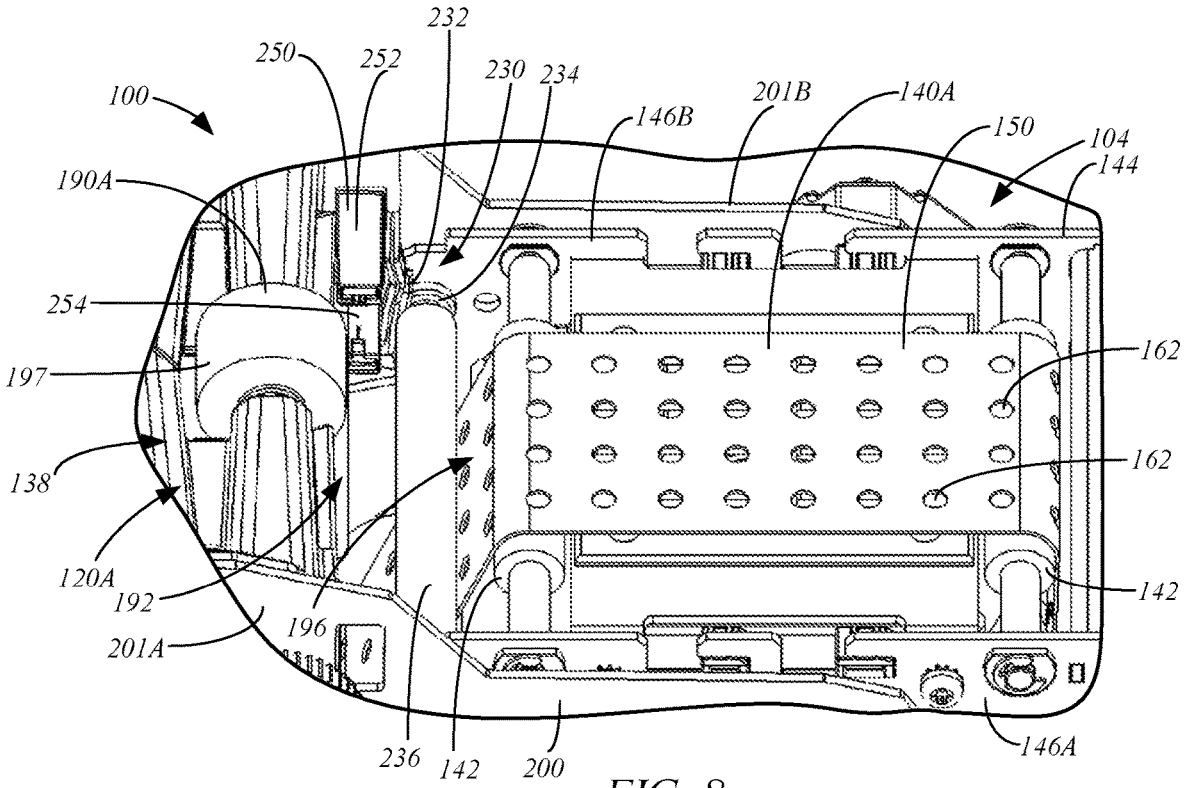
FIGS. 8 and 9 are front and top isometric views of a portion of an ink jet card printer at an interface between a card feeder and a belt, in accordance with embodiments of the present disclosure.
Figure 9:
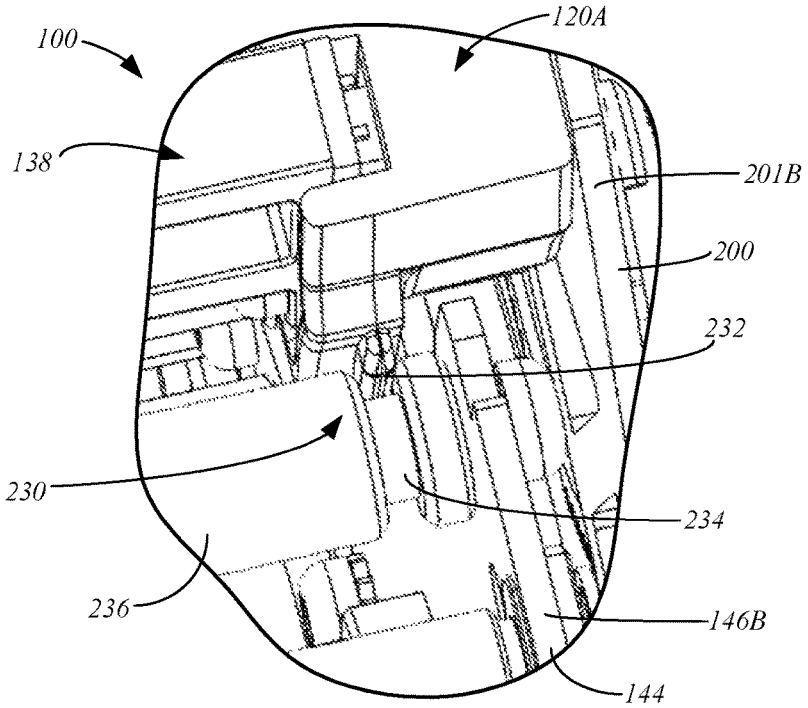

In some embodiments, a lateral stabilizer 230 is used in connection with each of the card feeders 120 to ensure substantial coaxial alignment in the horizontal plane between the card feed axis 208 and the processing axis 108 of the adjacent belt 140, as shown in FIG. 2, when the card feeders 120 are in their raised positions 138. One example of a suitable lateral stabilizer 230 is shown in FIGS. 8 and 9, which are front and top isometric views of a portion of the printer 100 at the interface between the card feeder 120A and the belt 140A with the ink collector 182 removed. In some embodiments, the lateral stabilizer 230 is positioned between the pinch roller pair 190A at the port 192 and the input/output end 196 of the adjacent belt 140A, as shown in FIG. 8.

In one embodiment, the lateral stabilizer 230 includes a first stabilizing member 232 connected to the card feeder frame 200, and a second stabilizing member 234 connected to the belt frame 144. Thus, the first stabilizing member 232 moves with movement of the card feeder frame 200 about the pivot axis 210 relative to the second stabilizing member 234. The first stabilizing member 232 engages with the second stabilizing member 234 in a cooperating manner when the card feeder 120 is moved from the lowered position 136 to the raised position 138 to provide the desired lateral alignment of the card feed axis 208 and the processing axis 108. In some embodiments, the first and second stabilizing members 232 and 234 are displaced from each other when the card feeder 120 is in the lowered position 136.

In one exemplary embodiment, the first stabilizing member 232 is in the form of a rib member and the second stabilizing member is in the form of a groove 234, as shown in FIGS. 8 and 9. Alternatively, the positions of the rib member and groove may be reversed. The groove 234 may be formed in a bar 236 extending between the side walls 146A and 146B of the belt frame 144. As the card feeder 120 is moved from the lowered position 136 to the raised position 138, the rib member 232 is received within the groove 234, as shown in FIG. 9, to align the card feed axis 208 with the processing axis 108 and maintain the alignment during card feeding operations between the card feeder 120A and the belt 140A.

Ideally, each card feeder 120 supports a received card 106 such that a central axis of the card 106 is aligned with the card feed axis 208. This ensures that the card 106 is fed to the adjacent belt 140 in alignment with the processing axis 108, which allows for accurate positioning of the card 106 in the print position 114 on the belt 140 and accurate printing of an image to the card surface 166.

Figure 10:
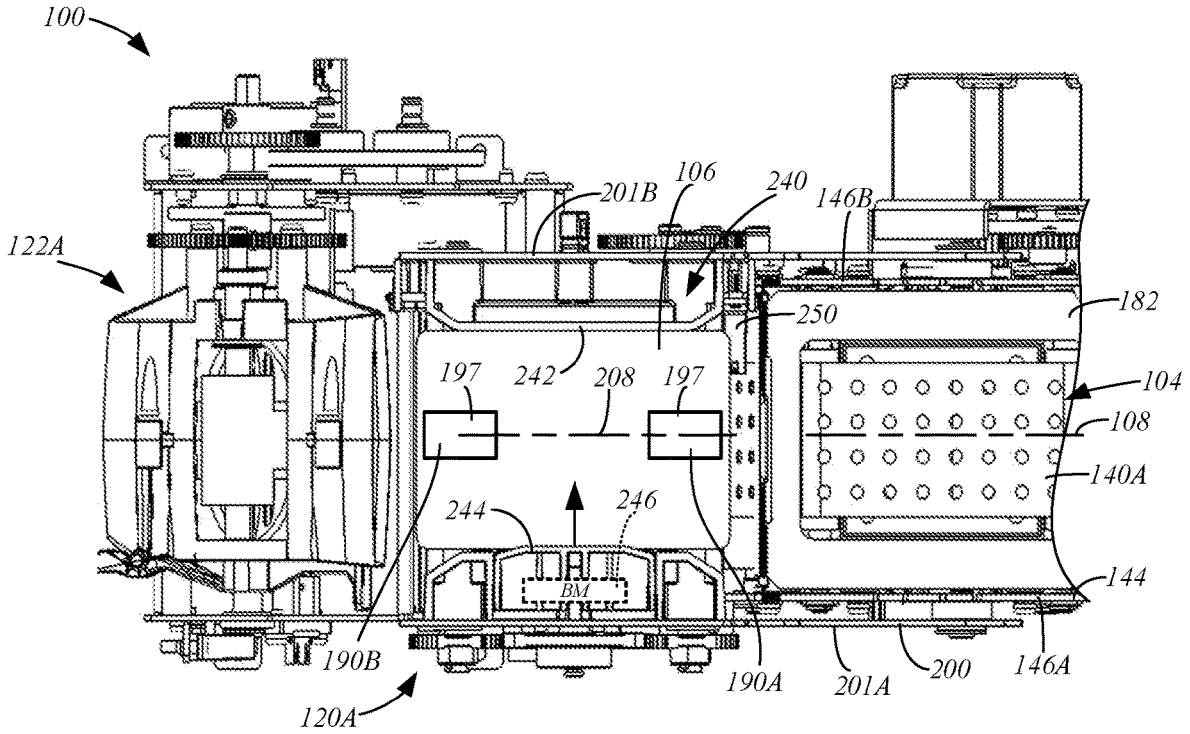
FIG. 10 is a top view of a portion of an ink jet card printer, in accordance with embodiments of the present disclosure.

In some embodiments, each card feeder 120 includes a card alignment mechanism 240, an example of which is illustrated in the top view of a portion of the printer 100 provided in FIG. 10 with the cover 202 removed. The card alignment mechanism 240 is configured to prevent misalignment between a card 106 supported by the one or more pinch roller pairs 190 of the card feeder 120 and the card feed axis 208. One embodiment of the card alignment mechanism 240 includes a reference wall 242, a pusher wall 244 and a biasing mechanism 246. The reference wall 242 is aligned parallel to the card feed axis 208 and has a fixed position relative to the card feeder frame 200. The pusher wall 244 is moveable relative to the card feeder frame 200 and the reference wall 242. The biasing mechanism 246 is configured to bias the pusher wall 244 toward the reference wall 242. Embodiments of the biasing mechanism 246 include a spring or another conventional biasing mechanism.

As a card 106 is received by the card feeder 120 with the central axis of the card 106 being offset from the card feed axis 208 or non-parallel to the card feed axis 208, the pusher wall 244 pushes the card 106 toward the reference wall 242 due to the bias produced by the biasing mechanism 246. This causes an edge of the card 106 to engage the reference wall 242. As the card 106 continues to be fed into the card feeder 120 by the pinch roller pairs 190, the edge of the card 106 engaging the reference wall 242 aligns with the reference wall 242 and aligns the central axis of the card 106 with the card feed axis 208.

The printer 100 may include one or more sensors 250 to facilitate various card feeding operations, such as receiving a card 106 in the card feeders 120 and positioning a card 106 in the print position 114 on the belts 140. In one embodiment, the printer 100 includes a card sensor 250 for detecting the presence or absence of a card at each side of the card transport 104, as indicated in FIG. 1. In some embodiments, the card sensors 250 are positioned between the pinch roller pair 190A and the adjacent belt 140. In some embodiments, the card sensors 250 are supported by the card feeder frame 200, as shown in FIGS. 3 and 8. The card sensors may take on any suitable form, such as an optical card sensor having an emitter 252 and a receiver 254, as shown in FIG. 8.

During reception of a card 106 by a card feeder 120 in its lowered position 136, the sensor 250 may be used to detect the leading edge of the card 106 being fed toward the card transport belt 140, which may indicate that the card 106 is fully received in the card feeder 120. The card feeder 120 may then be moved from the lowered position 136 to the raised position 138. After the card feeder 120 is moved to the raised position 138, the corresponding card sensor 250 may be used to detect the trailing edge of the card 106 as the card is fed to the adjacent belt 140. The controller 118 may use this detection of the trailing edge of the card 106 to control the belt 140 to position the card 106 in the desired print position 114.

The card sensors 250 may also be used by the controller 118 to control the reception of cards 106 fed from the belts 140 by the card feeders 120. For example, as a card 106 is fed from the belt 140 toward the card feeder 120, the card sensor 250 may detect the leading edge of the card 106. This detection may be used by the controller 118 to control the pinch roller pairs 190 to receive the card 106 in the card feeder 120. The card 106 may then be fed into the card feeder 120 using the pinch roller pairs 190 until the sensor 250 detects the trailing edge of the card 106 indicating that the card 106 has been fully received within the card feeder 120 and that the card feeder 120 is ready to be moved to its lowered position 136.

As mentioned above, the printer may optionally include one or more card flippers 122 that may be used to invert cards 106 to facilitate printing operations on both sides of the cards 106. Each card flipper 122 may be configured to receive a card 106 from the adjacent card feeder 120, the card supply (flipper 122A) or the card collector (flipper 122B), rotate the card 106 about a flipping axis 260 to invert the card 106, and pass the inverted card 106 back to the adjacent card feeder 120, which can deliver the inverted card 106 to the card transport 104 and the print unit 102 for a printing operation. The card flippers 122 may each be conventional card flippers. One suitable card flipper 122 which may be used by the printer is described in U.S. Pat. No. 7,878,505, which issued to HID Global Corporation and is incorporated herein by reference in its entirety.

In some embodiments, each flipper 122 includes a pinch roller pair 262 that is configured to hold the card 106 during rotation about the flipping axis 260. One or more motors 264 (FIGS. 1 and 5) are used to drive rotation of a gear 266, that supports the pinch roller pair 262 and a card 106 supported by the pinch roller pair, about the flipping axis 260. In some embodiments, the card feed axis 268 of each flipper 122 is configured to rotate into alignment with the card feed axis 208 of the adjacent card feeder 120 when it is in the lowered position 136. The motor 264 may also drive the pinch roller pair 262 to feed a card 106 supported by the pinch roller pair 262 to the pinch roller pair 190B at the port 194 of the adjacent card feeder 120, such as shown in FIG. 5. The adjacent card feeder 120 may then move to the raised position 138 and feed the card 106 to the adjacent belt 140, as shown in FIG. 7.

Some embodiments of the present disclosure are directed to methods of printing an image to one or more cards 106 using the ink jet card printer 100. In one embodiment of the method, a card 106, which may have been received from the supply 124 and fed to the card feeder 120A by the card flipper 122A, is supported by the pinch roller pairs 190 of the card feeder 120A while in its lowered position 136, as shown in FIG. 5. The card feeder 120A is moved to its raised position 138 using the corresponding lift mechanism 134, and the card 106 is discharged from the card feeder 120A to the belt 140A using the pinch roller pair 190A. The card feeder 120A is then moved to the lowered position 136 (FIGS. 4 and 5) and out of the print zone 116 using the lift mechanism 134, and the card 106 is fed along the processing axis 108 by the belt 140A to the print position 114 (FIG. 2). An image is then printed to the surface 166 of the card 106 using the print head 110, which involves moving the print head 110 with the gantry 112 through the print zone 116, as indicated in FIGS. 1 and 2.

Figure 11:
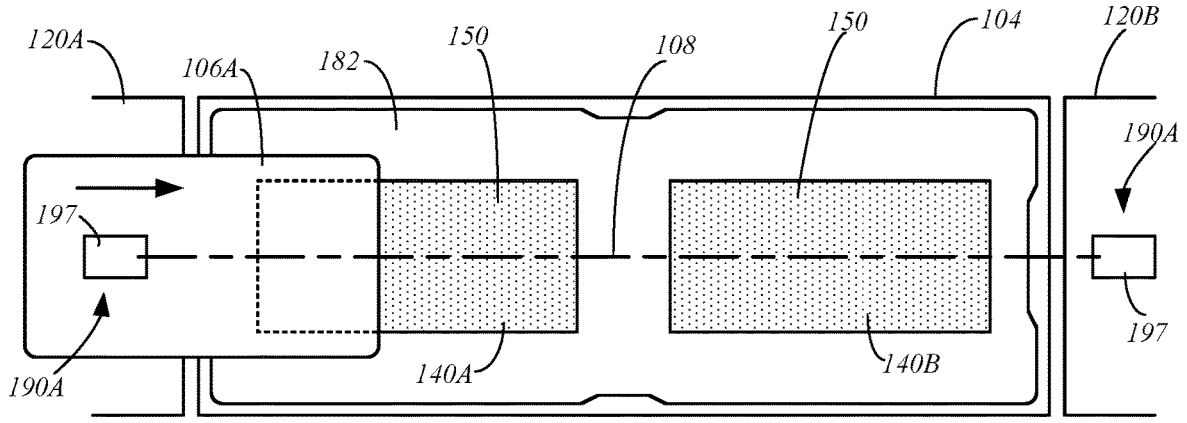
FIGS. 11-16 are simplified top views of a card transport and card feeders during various stages of a printing operation, in accordance with embodiments of the present disclosure.
Figure 12:
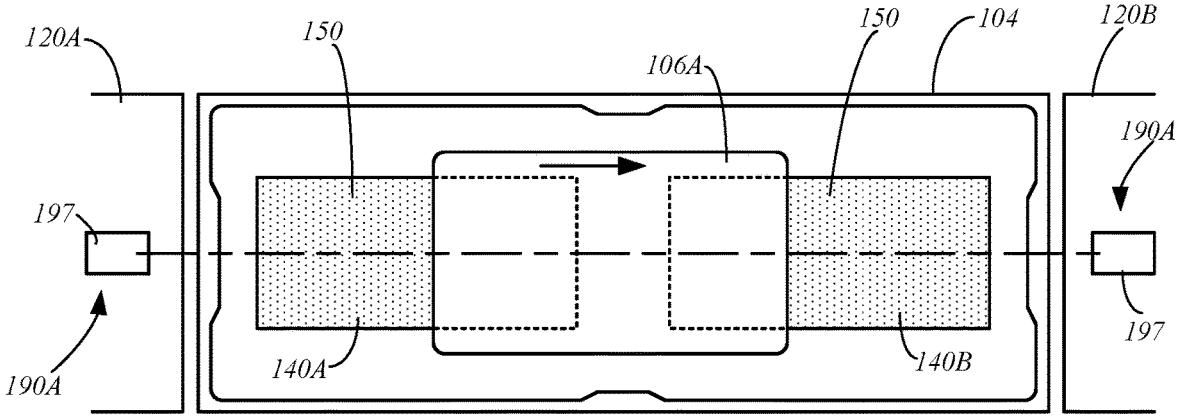
Figure 13:
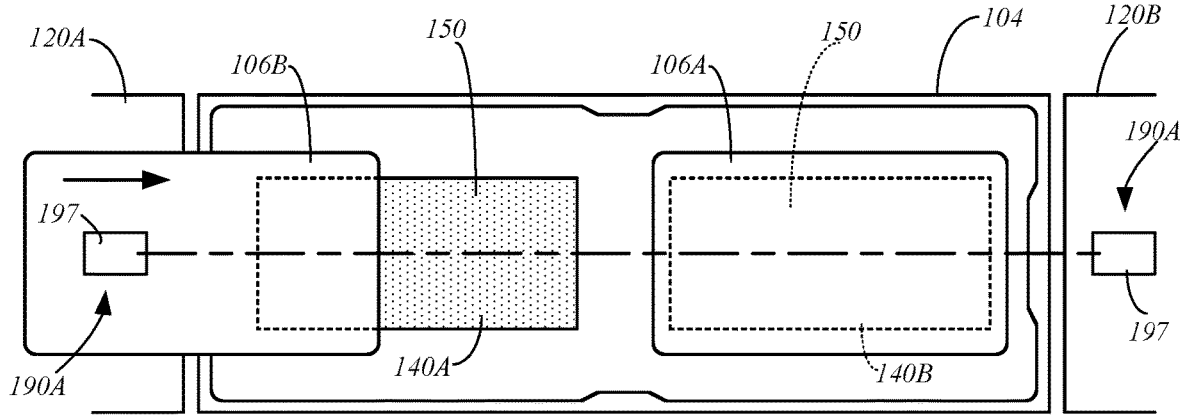
Figure 14:
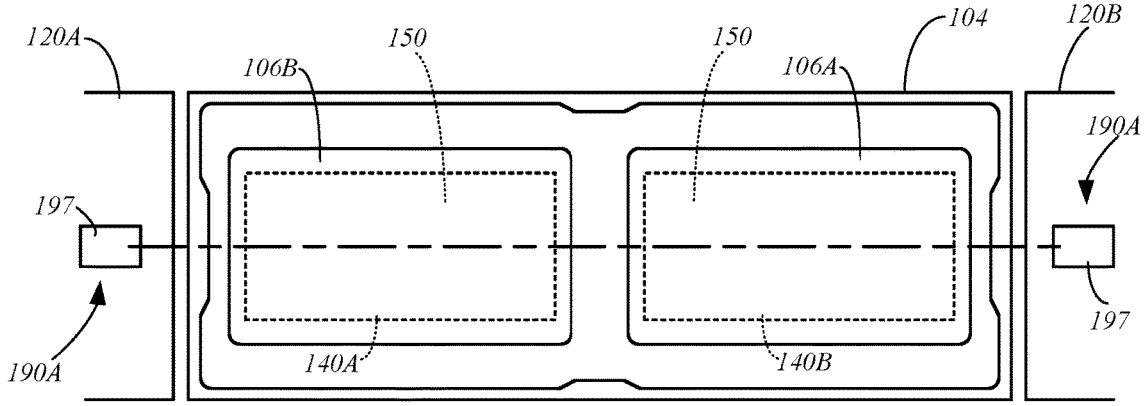

Some embodiments of the method involve performing a print operation using the ink jet card printer 100 to print images on two cards 106 simultaneously. One example of such a method will be described with reference to FIGS. 11-16, which are simplified top views of the card transport 104 and the card feeders 120A and 120B during various stages of the method. Initially, a pair of cards 106 may be fed from the supply 124 to the card transport 104 with the card feeders 120 in their lowered positions 136. This may involve feeding a first card 106 from the supply 124 through the card flipper 122 to the card feeder 120A, as shown in FIGS. 1 and 5. The card feeder 120A may then be moved to its raised position 138 using the lift mechanism 134, and the first card 106A is fed to the belt 140A by the pinch roller pair 190A, as shown in FIG. 11. The card feeder 120A may then return to its lowered position 136, and a second card 106 may be fed from the supply 124 through the flipper 122A to the card feeder 120A in the same manner as the first card. During the feeding of the second card 106A to the card feeder 120A, the first card 106A may be fed by the belt 140A to the belt 140B, during which the card 106A is simultaneously supported by both belts 140A and 140B, as shown in FIG. 12. The card 106A may then be moved by the belt 140B to the print position 114, as shown in FIG. 13. The second card 106B is fed to the belt 140A using the pinch roller pair 190A of the card feeder 120A, as indicated in FIG. 13, and the second card 106B is moved along the processing axis 108 by the belt 140A to its print position 114, as shown in FIG. 14. The card feeder 120A is then moved to its lowered position 136.

With the cards 106A and 106B supported in their print positions 114 on the belts 140B and 140A, and the card feeders 120A and 120B in their lowered positions 136 (FIG. 5), a printing operation is simultaneously performed on the first and second cards 106A and 106B using the print unit 102, as discussed above with reference to FIG. 2. This printing operation involves moving the ink jet print head 110 in the fast scan direction 130 across the cards 106 and moving the ink jet print head 110 in a slow scan direction 132 that is perpendicular to the fast scan direction 134 through the print zone 116 using the gantry 112. The cards 106 are imaged by the ink jet print head (i.e., active printing phase) while the print head 110 is moved in the fast scan direction 130 by the gantry 112.

Figure 15:
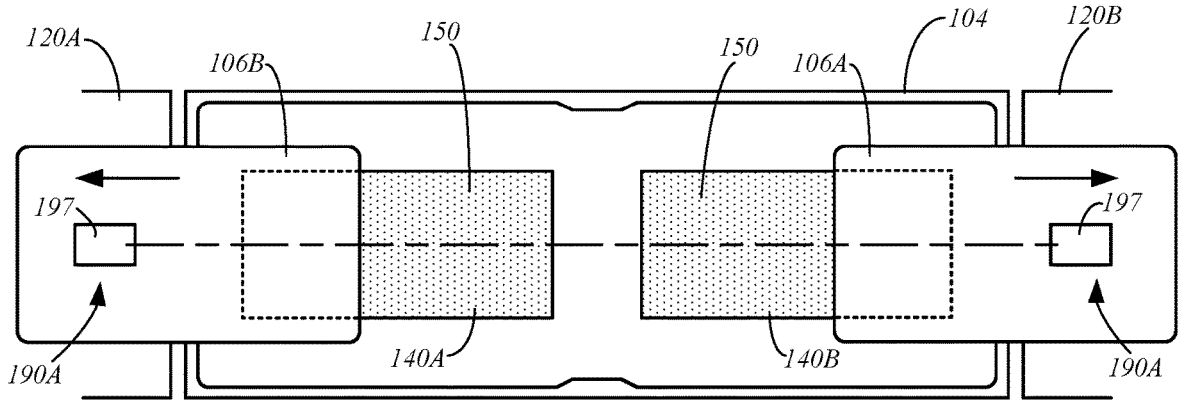
Figure 16:
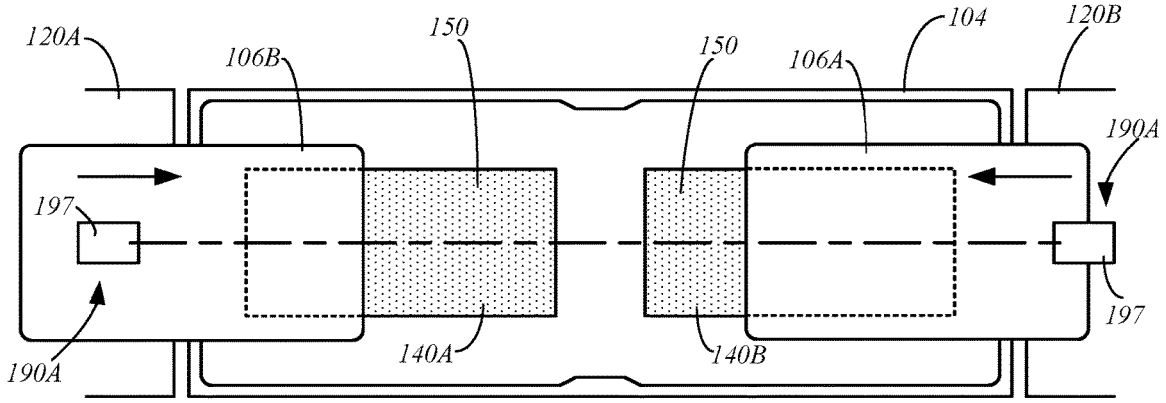

After the images have been printed to the cards 106A and 106B, the card feeders 120A and 120B are returned to their raised positions 138 by the lift mechanisms 134, and the cards 106A and 106B are delivered to the adjacent card feeders 120A and 120B using the belts 140A and 140B, as indicated in FIG. 14. After receiving the cards 106A and 106B, the card feeders 120A and 120B are moved to their lowered positions 136 by the lift mechanisms 134, and the cards 106A and 106B are fed to the corresponding flippers 122A and 122B, such as generally shown in FIG. 5. The flippers 122A and 122B invert the cards 106A and 106B and feed the inverted cards back to the card feeders 120A and 120B, which are then returned to their raised positions 138. The cards 106A and 106B are then fed back to the adjacent belts 140A and 140B by the card feeders 120A and 120B, as indicated in FIG. 15. The belts 140A and 140B then move the cards 106B and 106A to the print positions 114 (FIG. 13) and the card feeders 120A and 120B are again moved to their lowered positions 136. The print head 110 then prints images to the non-imaged surfaces 166 of the cards 106A and 106B as discussed above with reference to FIG. 2.

With images printed to both sides of the cards 106A and 106B, the cards may be discharged to the collector 126 using the card feeder 120B. The card feeder 120B is first moved to the raised position 138, and the belt 140B feeds the card 106A to the card feeder 120B. The card feeder 120B is then moved to its lowered position 136, and the card 106A is fed to the collector 126 through the flipper 122B (FIG. 5). The card 106B is fed from the belt 140A to the belt 140B and the card feeder 120B is returned to the raised position 138. The card feeder 120B then receives the card 106B from the belt 140B, and is moved to its lowered position 136 by the corresponding lift mechanism 134. The card 106B can then be discharged from the card feeder 120B to the collector 126 through the flipper 122B.

Although the embodiments of the present disclosure have been described with reference to preferred embodiments, workers skilled in the art will recognize that changes may be made in form and detail without departing from the spirit and scope of the present disclosure. It is appreciated that certain features of the present disclosure, which are, for clarity, described in the context of separate embodiments, may also be provided in combination in a single embodiment. Conversely, various features of the present disclosure, which are, for brevity, described in the context of a single embodiment, may also be provided separately or in any suitable subcombination or as suitable in any other described embodiment of the present disclosure. Certain features described in the context of various embodiments are not to be considered essential features of those embodiments, unless the embodiment is inoperative without those elements. As used herein the term "approximately," "about" or "substantially" generally refers to ±5% of the referenced value and denotes equality with a tolerance of at most 5%, unless stated otherwise. The terms "substantially parallel" or "substantially perpendicular" refer to a tolerance of ±5 degrees, unless otherwise specified.

What is claimed is:

1. An ink jet card printer comprising:
an ink jet print head configured to perform a print operation on a card supported in a print position along a processing axis;
a gantry configured to move the print head through a print zone; and
a card feeder comprising:
a feeder frame;
a first pinch roller pair supported by the feeder frame and configured to feed individual cards along a card feed axis; and
a lift mechanism configured to move the feeder frame and the first pinch roller pair between a lowered position, in which the card feeder is displaced from the print zone, and a raised position, in which at least a portion of the card feeder extends into the print zone.

2. The ink jet card printer of claim 1, wherein the lift mechanism is configured to pivot the feeder frame and the card feed axis about a pivot axis, which is positioned below the print zone, to move the feeder frame between the lowered and raised positions.

3. The ink jet card printer of claim 2, wherein:
the lift mechanism includes a cam, a cam follower, and a motor; and
engagement between the cam follower and the cam drives the feeder frame between the lowered and raised positions in response to rotation of the cam by the motor.

4. The ink jet card printer of claim 2, wherein:
the ink jet card printer includes a card transport comprising a belt configured to feed a card along the processing axis, the belt supported by a belt frame;
the card feeder is configured to deliver cards to the belt when in the raised position; and
the pivot axis is defined by a pivotable connection between a feeder frame and the belt frame.

5. The ink jet card printer of claim 4, further comprising a lateral stabilizer including a first stabilizing member attached to the feeder frame, and a second stabilizing member attached to the belt frame, wherein the first and second stabilizing members engage each other and maintain alignment between the card feed axis and the processing axis when the feeder frame is in the raised position, and the first and second stabilizing members are disengaged from each other when the feeder frame is in the lowered position.

6. The ink jet card printer of claim 5, wherein the first and second stabilizing members include a groove and a rib member, wherein the rib member is received within the groove when the feeder frame is in the raised position.

7. The ink jet card printer of claim 4, wherein the card feed axis is substantially parallel with the processing axis when the feeder frame is in the raised position, and the card feed axis is at an oblique angle to the processing axis when the feeder frame is in the lowered position.

8. The ink jet card printer of claim 7, wherein the card feeder includes a card sensor positioned between the first pinch roller pair and the belt, the card sensor configured to facilitate positioning a card in a received position within the card feeder, in which the card feeder is configured to transition between the lowered and raised positions while holding the card.

9. The ink jet card printer of claim 1, wherein the card feed axis is oriented at an oblique angle to the processing axis when the card feeder is in the lowered position.

10. The ink jet card printer of claim 1, wherein the card feeder includes:
a reference wall aligned substantially parallel to the card feed axis and having a fixed position relative to the feeder frame;
a pusher wall movable relative to the feeder frame and the reference wall; and
a biasing mechanism configured to bias the pusher wall toward the reference wall;
wherein a card received by the card feeder is pressed against the reference wall by the pusher wall.

11. The ink jet card printer of claim 4, wherein:
the first pinch roller pair is positioned at a first port;
the card feeder includes a second pinch roller pair supported by the feeder frame at a second port; and
the card feeder is configured to hold a card in a received position using the first and second pinch roller pairs when the card feeder is moved between the lowered and raised positions using the lift mechanism.

12. The ink jet card printer of claim 11, wherein:

each of the first and second pinch roller pairs includes an idler roller and a feed roller; and the card feeder includes at least one motor configured to drive rotation of the feed rollers.

13. The ink jet card printer of claim 12, wherein the card feeder is configured to receive individual cards through the second port using the second pinch roller pair when the card feeder is in the lowered position.

14. The ink jet card printer of claim 13, further comprising a card flipper adjacent the second port of the card feeder, the card flipper configured to invert individual cards and feed individual cards to the second pinch roller pair when the card feeder is in the lowered position.

15. A method of feeding a card in an ink jet card printer, which includes an ink jet print head supported for movement within a print zone during printing of an image to a card supported along a processing axis, the method comprising:

supporting a card in a card feeder in a raised position, in which at least a portion of the card feeder extends into the print zone;

feeding the card from the card feeder along a card feed axis that is substantially parallel the processing axis to a card transport using a first pinch roller pair supported by a feeder frame of the card feeder; and pivoting the feeder frame, the first pinch roller pair and the card feed axis about a pivot axis to a lowered position, in which the card feeder is displaced from the print zone and the card feed axis is oblique to the processing axis, using a lift mechanism.

16. The method of claim 15, further comprising:

feeding the card along the processing axis to a print position using a belt of the card transport; and printing an image to a surface of the card using the print head including moving the ink jet print head within the print zone using the gantry.

17. The method of claim 16, wherein:

supporting the card in the card feeder comprises supporting the card with the first pinch roller pair and a second pinch roller pair of the card feeder, wherein the first and second pinch roller pairs are displaced from each other along the card feed axis; and feeding the card from the card feeder comprises driving motorized rollers of the first and second pinch roller pairs using a motor.

18. The method of claim 17, wherein supporting the card in the card feeder comprises:

receiving the card in the card feeder using the first pinch roller pair when the card feeder is in the lowered position; and pivoting the feeder frame, the first pinch roller pair and the card feed axis about the pivot axis to the raised position using the lift mechanism.

19. The method of claim 18, wherein receiving the card in the card feeder comprises pressing the card against a reference wall of the card feeder that is aligned substantially parallel to the card feed axis using a pusher wall and a biasing mechanism of the card feeder.

20. A card feeder comprising:

a feeder frame configured for operably coupling with an ink jet card printer, wherein the ink jet card printer includes an ink jet print head supported for movement within a print zone during printing of an image to a card;

a first pinch roller pair supported by the feeder frame and configured to feed individual cards along a card feed axis; and a lift mechanism configured such that when operably coupled with the ink jet card printer, the feeder frame and the first pinch roller pair are pivotable about a pivot axis between a lowered position, in which the card feed axis has a first angular position about the pivot axis and the card feeder is displaced from the print zone, and a raised position, in which the card feed axis has a second angular position about the pivot axis that is different from the first angular position and in which at least a portion of the card feeder extends into the print zone.

* * * * *